United States Patent [19]

Schott Malo et al.

[11] 4,245,672

[45] Jan. 20, 1981

[54] SEALING VALVE FOR SLUDGE SCAVENGING SYSTEM

[76] Inventors: Carlos Schott Malo; Carlos C. Schott Dubon, both of Paseo Maria Agustin, 4-6, Saragossa, Spain

[21] Appl. No.: 889,821

[22] Filed: Mar. 24, 1978

Related U.S. Application Data

[63] Continuation-in-part of Ser. No. 888,662, Mar. 21, 1978, abandoned.

[30] Foreign Application Priority Data

Mar. 21, 1977 [ES] Spain ..... 457.022

[51] Int. Cl.[3] ..... F16K 7/07

[52] U.S. Cl. ..... 137/869; 137/881; 175/69; 175/218; 251/5

[58] Field of Search ..... 251/5, 61.1; 175/218, 175/65, 67, 69; 137/583, 589, 861, 869, 877-878, 883, 885-886; 285/153, DIG. 25

[56] References Cited

U.S. PATENT DOCUMENTS

| | | | |
|---|---|---|---|
| 1,517,504 | 12/1924 | Hansen | 137/613 X |
| 2,828,101 | 3/1958 | Antram | 251/5 |
| 2,898,078 | 8/1959 | Stephenson et al. | 251/5 |
| 3,709,248 | 1/1973 | Aurich et al. | 137/883 X |
| 3,877,529 | 4/1975 | Litchfield | 175/218 X |

*Primary Examiner*—Martin P. Schwadron
*Assistant Examiner*—Richard Gerard
*Attorney, Agent, or Firm*—Ostrolenk, Faber, Gerb & Soffen

[57] ABSTRACT

A drilling rig comprising a plurality of pipes connected in a row, with a drill at the lower end; the rotation transmitting bar or Kelly bar at the top end of the drilling rig must be periodically disconnected so as to install a new pipe section; the invention comprises a valve to seal the upper rotating or Kelly bar when it is disconnected so as to keep the sludge pump primed; the valve comprising a collapsible diaphragm which is forced shut by pressurized fluid to seal the rotating or Kelly bar; and an air escape valve communicating into the row of pipes beneath the sealing valve for effecting removal of air trapped beneath the rotating or Kelly bar valve.

10 Claims, 6 Drawing Figures

SEALING VALVE FOR SLUDGE SCAVENGING SYSTEM

This is a continuation-in-part of application Ser. No. 888,662, filed Mar. 21, 1978, now abandoned.

BACKGROUND OF THE INVENTION

A drill rig is comprised of a series of pipes all rotated by a rotating means above the ground. The lowermost pipe carries the rotated drilling tool. During the operation of the drill rig, a process sometimes known as inverse circulation is used in which sludge produced by an earth cutting or rock drilling tool is channeled out of the hole through the interiors of a row of drilling pipes. In this process, the hole being drilled is kept filled with water up to ground level. Usually, the water fed to the hole comes from a pond or reservoir and gradually either seeps into the hole or is pumped there. The sludge that is produced during the drilling in the water filled hole is conducted through the pipes of the drill rig to the ground surface level. Usually, a suction pump draws out the sludge. The withdrawn sludge is transferred to that pond or reservoir that supplies the water, thus establishing a continuous fluid circuit during the drilling operation.

In another technique for removing sludge, means are provided for injecting air into the drilling pipes near the bottom of the series of pipes. The air and sludge mix together, and the sludge becomes aerated, it loses its density and its lifting speed increases. In some cases, it is not even necessary to use the suction pump to remove the sludge to the pond or reservoir.

The series of pipes of which a drill is comprised includes an uppermost rotating or Kelly bar beneath which is arrayed the row of extension rods which eventually connect to the drill bit at the lower end. As the drill cuts deeper into the hole, additional pipe sections must be installed. To effect this, the uppermost rod section beneath the rotating or Kelly bar is disconnected from that bar and an additional pipe section is installed between the rotating or Kelly bar and the previous uppermost pipe section. The pipe sections and rotating or Kelly bar are secured together and drilling is continued with the now longer pipe assembly. During the time that the Kelly or rotating bar is disconnected, water or sludge then in the Kelly or rotating bar runs out its bottom end. The previously primed suction pump is no longer primed. It is thus necessary to prime the suction pump again, causing a loss of time in the drilling operation. Further, air will now be drawn through the pipe connections, creating further difficulties until the pump and the entire pipe system is eventually primed again.

SUMMARY OF THE INVENTION

The present invention comprises a valve which may be operated to seal or open the passageway through the rotating or Kelly bar. When the valve is closed, there cannot be any leakage out of the rotating or Kelly bar. The pump and the whole system will remain primed while the rotating or Kelly bar is disconnected and while a new section of pipe is being installed. In a preferred form of the invention, the valve in the rotating or Kelly bar comprises a flexible membrane or diaphragm or other membrane means which are operated to occlude the passage through the rotating or Kelly bar by means of a pressurized fluid medium which alternately moves the membrane means to seal or open the passage.

A secondary valve is connected with the pipe sections just beneath the primary valve for permitting the exit of air trapped in the new pipe section, thereby eliminating the passage of air bubbles through the Kelly or rotating bar and through the suction pump. The exit of air through the secondary valve is caused by the hydrostatic pressure in the drill hole, which is caused by the water level in the hole reaching toward the top of the hole.

Accordingly, it is the primary object of the present invention to make the operation of a drilling rig more efficient.

It is another object of the invention to enable the suction pump used in removal of sludge from a drilling hole to remain primed as new sections of the drilling pipe are installed.

It is a further object of the invention to minimize the undesirable passage of air from the sections of a drilling rig pipe through a suction pump used to remove the sludge from the holes being drilled.

These and other objects of the invention will become apparent from the following description taken in conjunction with the accompanying drawings.

DESCRIPTION OF A PREFERRED EMBODIMENT

Figure 1:
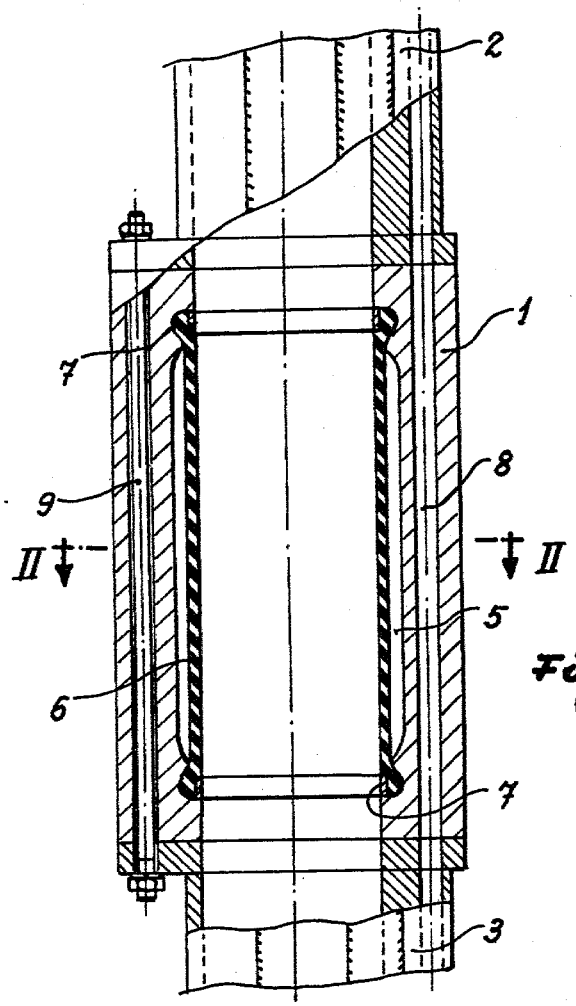
FIG. 1 is a longitudinal cross-sectional view, taken along the line I—I of FIG. 2 and showing the rotational or Kelly bar of a drilling rig pipe assembly in the open, unoccluded condition.
Figure 2:
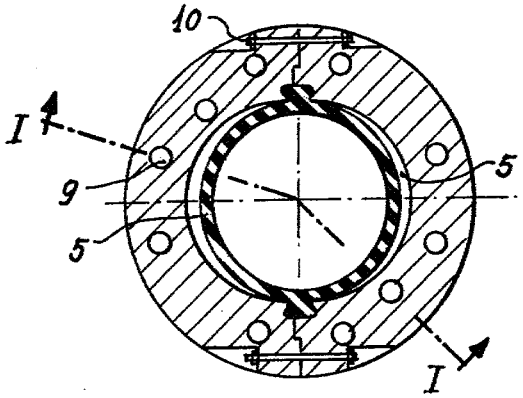
FIG. 2 is a cross-sectional view in plan along the line II—II of FIG. 1 of the rotation or Kelly bar shown in FIG. 1.

Referring to FIGS. 1 and 2, a fragment of a drive shaft of a drilling rig system in the vicinity of the rotational or Kelly bar 2 is shown. The rotational or Kelly bar 2 is at the top end. There is connected to the lower end of the rotational or Kelly bar the adjacent drilling pipe 3. A continuous passageway extends through the drilling pipe sections 3 and the Kelly bar 2. At the lower end of the Kelly bar 2 between the Kelly bar and the adjacent drilling pipe section 3, the main valve body 1 is coaxially mounted. It also has a passage extending through it which is coaxial with the passageway through the Kelly bar 2 and pipe section 3. The lower end of the Kelly bar 2 and the upper end of the pipe section 3 are secured by appropriate flanges and the fastening screws 9 to the main valve body 1, making a continuous, tightly secured conduit system.

As shown in FIG. 2, the main valve body 1 is comprised of two semi-cylindrical shells which are joined by the transverse fastening screw means 10 to form a unitary sealed cylinder.

Within the shells of the valve body 1 is installed an elastic material valve sealing tube 6, which is a flexible membrane, diaphragm, or the like comprised of rubber, flexible plastic, flexible metal or another material that is sufficiently durable to withstand the wearing friction as the pump sludge passes through the elastic sealing tube 6. As can be seen from FIG. 2, the tube 6 is comprised of two longitudinally extending, generally semicylindrical sections, having longitudinal edges that meet along the illustrated opposite longitudinal junction lines. At the top and bottom ends of the tube 6, the tube is formed with integral, outwardly projecting retention rings 7. The shells of valve body 1 are internally correspondingly deformed so as to hold the retention rings, thereby holding the tube 6 in its longitudinally extended condition through operation between the open (FIG. 1) and occluded (FIG. 3) conditions.

Figure 3:
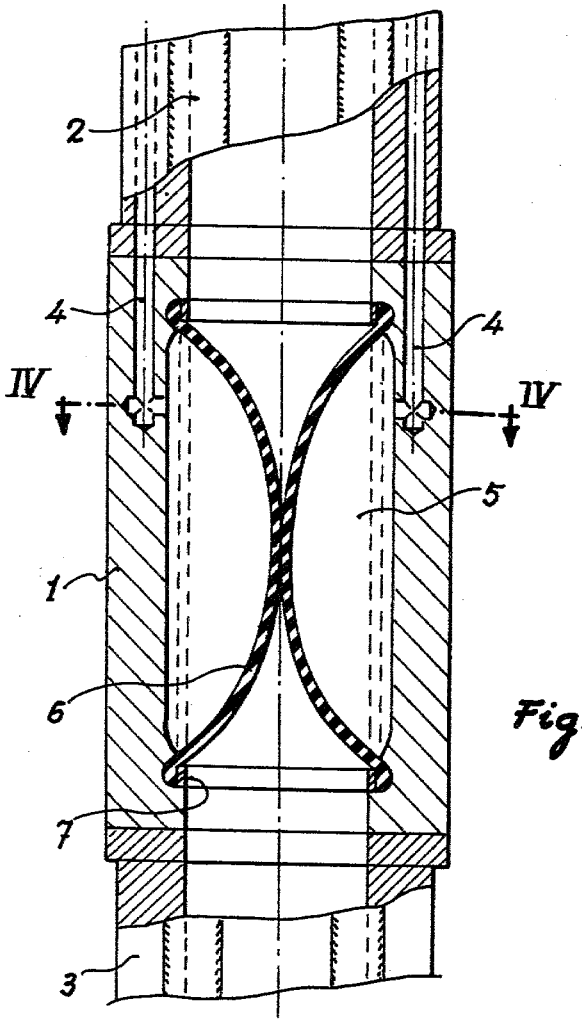
FIG. 3 is another longitudinal cross-sectional view of the Kelly bar of FIG. 1, this time along the line III—III of FIG. 4 and showing the passageway through the Kelly bar occluded.
Figure 4:
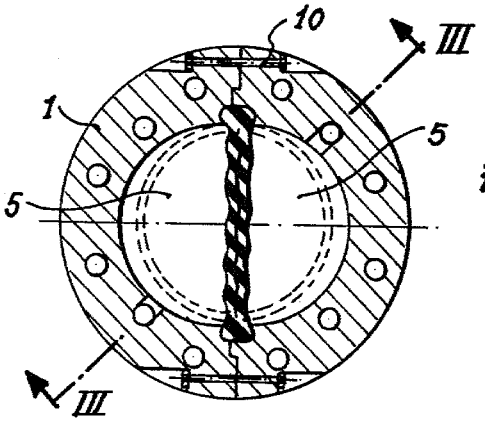
FIG. 4 is a cross-sectional view in plan of the Kelly bar shown in FIG. 3, along the line IV—IV in FIG. 3.

Further, as shown in FIG. 1, the passageway through the shells of the valve body 1 that carries the elastic tube 6 includes open chambers 5 exterior to the tube 6 in both shells for receiving air or any other fluid to be pumped into the chambers 5. With reference to FIGS. 3 and 4, separate air or fluid transmitting ducts 4 communicate with the chambers 5 in both shells for conducting or moving air or fluid from these chambers. When air or fluid is pumped into the chambers 5, as shown in FIG. 3, the elastic tube 6 is deformed so as to seal the passageway through the main valve body 1.

In addition to the ducts 4, there are additional ducts 8 that extend through all of the rotational or Kelly bar 2 and the communicating pipe sections 3 for transmitting air to the drill bit.

With reference to FIGS. 3 and 4, when air or other fluid is injected into the chambers 5 and the sealing tube 6 deforms to occlude the passage through the main valve body 1, the pipe section 3 may be disconnected from the valve body 1 and another pipe section may be installed beneath the body 1 and connected to the previous pipe section 3 so as to lengthen the drilling pipe. Yet, because the valve body 1 is sealed, the water and sludge in and above the valve body 1 and the Kelly or rotational bar 2 is not discharged.

Figure 5:
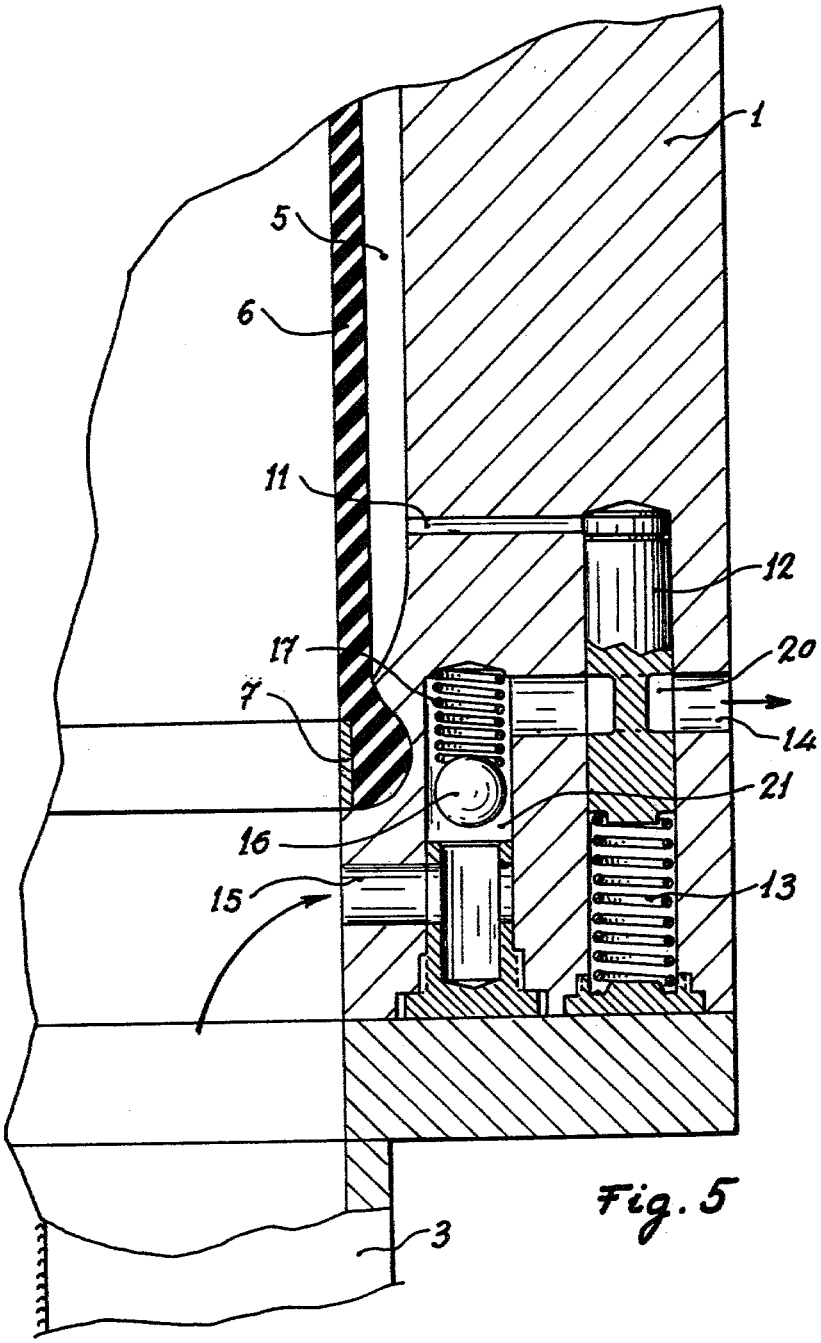
FIG. 5 is a longitudinal cross-sectional view of a fragment toward the lower end of the rotational or Kelly bar and showing a secondary valve for air escape in the open position.

With reference to FIG. 5, at the lower end of the valve body 1 and at the bottom of the sealing tube 6, the secondary valve of FIG. 5 is incorporated in the valve body 1. The secondary valve comprises a main cylinder 19, which communicates through the duct 11 with the pressurizable chamber 5 of the main valve. A piston 12 is positioned in and seals the cylinder 19. Piston 12 has a head that blocks the duct 11 when the piston 12 is elevated in the cylinder 19. The compression spring 13 normally urges the piston 12 upwardly to the position of FIG. 5, thereby blocking the duct 11.

Piston 12 also has a bypass means comprising an annular groove 20 extending around it and located intermediate its length. There is an air outlet duct 14 extending through the exterior of the main body 1. The annular groove 20 along piston 12 is so placed that it aligns with the air outlet duct 14 when the piston 12 is operated to fully block the duct 11.

The air outlet duct 14 communicates with the chamber 21. In chamber 21 is a ball check valve 16, which is normally urged against its lower valve seat by the spring 17. An air duct 15 communicates beneath the elastic sealing tube valve body 1 and into the top end of the uppermost drilling pipe section 3. Hence, the air under pressure in the drilling pipe 3 communicates through the duct 15 past the check valve 16 and through the duct 14 to the exterior of the pipe sections.

Figure 6:
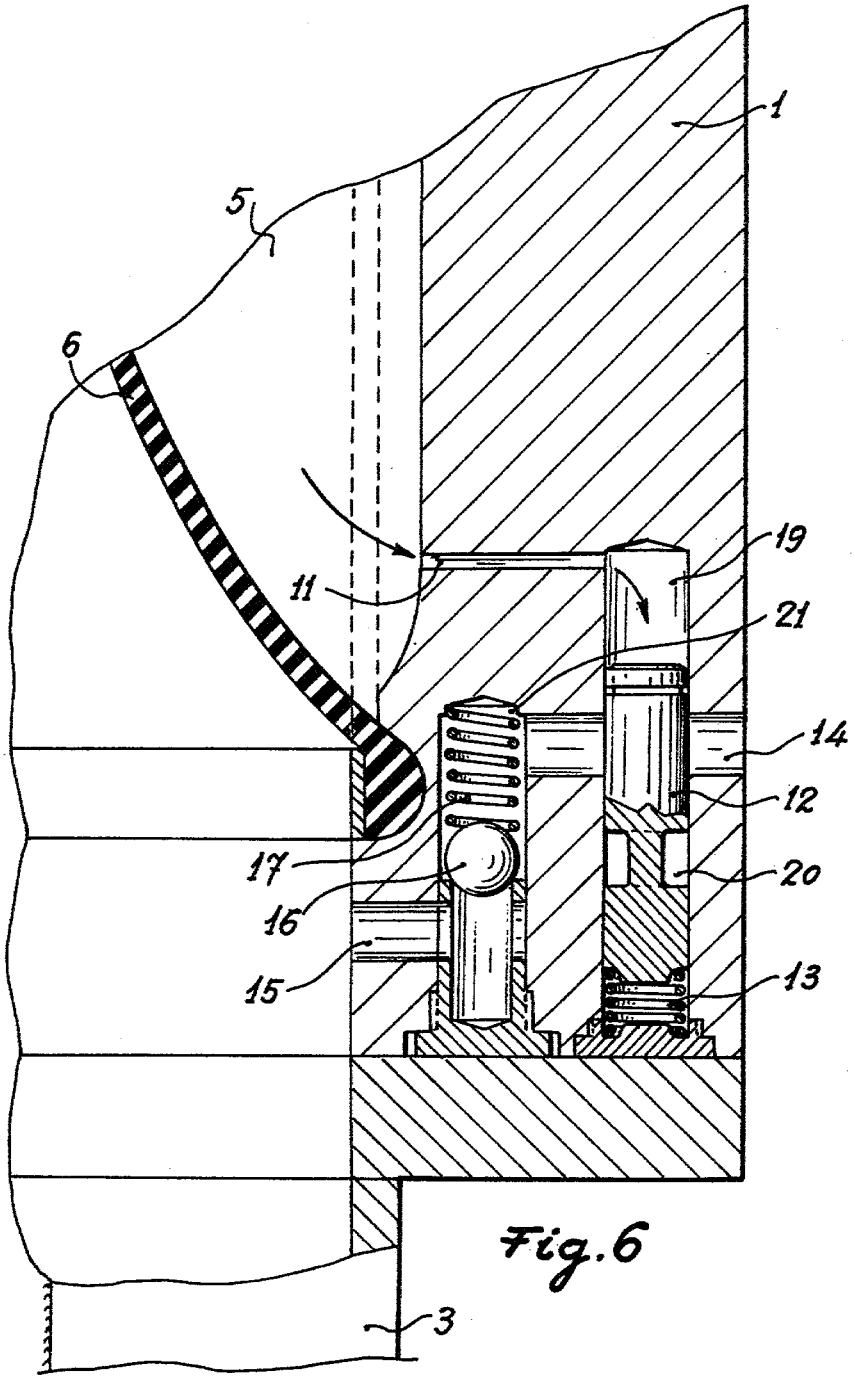
FIG. 6 is the same view as FIG. 5, but showing the secondary valve in the closed condition.

In operation of the apparatus, rotation of the array of drilling pipe sections is halted to install a new pipe section 3. Air or other fluid is injected through the ducts 4 into the chambers 5 which closes the elastic sealing tube valve 6. The piston 12 is shaped at its upper end such that it seals duct 11 so as to enable the pressure in duct 11 to force the piston 12 downwardly from the position of FIG. 5 to the position of FIG. 6. In this position, the piston 12 blocks the air outlet duct 14. After the new pipe section 3 has been connected, it is introduced into the drill hole.

Once the drill pipe has been submerged and placed in the drilling position, the air or other fluid in sealing chambers 5 is evacuated and the elastic sealing valve returns from its condition of FIGS. 3 and 4 to its condition of FIGS. 1 and 2, opening the passageway to the pump. The air in the new pipe section is forced by the hydrostatic pressure through duct 15 and chamber 21 and outlet duct 14, lifting valve 16 off its seat. The hydrostatic pressure is established because the process of inverse circulation requires that the drill hole be filled with water to the top of the hole. Simultaneously, the absence of pressure on piston 12 from chamber 5 enables the piston 12 to rise due to the counter thrust of spring 13. The check valve 16 closes, the outlet duct 14 opens and air in the pipe beneath valve body 1 escapes through the duct 14. At this moment, the drilling pipe is without air, the suction pump is primed and the machine is ready to continue drilling without having to use other or auxiliary pump priming systems.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A rotatable drive shaft for a drill bit comprising separable pipe sections wherein sludge is conveyed through said drive shaft and a valve system for connecting said pipe sections in said drive shaft, comprising:

a first pipe and a second pipe section of said drive shaft;

a main valve connected between said first and said second pipe sections for connecting those said pipe sections; said main valve being disconnectable from said second pipe section while remaining connected to said first pipe section;

first means operable by fluid pressure for selectively closing said main valve, whereby said second pipe section may be disconnected from said first pipe section without sludge leaking from said first pipe section, and for opening said main valve; second means in said main valve for communicating fluid pressure to said first means;

a secondary valve connected to said second pipe section at the side of said main valve that communicates with said second pipe section; said secondary valve communicating externally of said second pipe section for permitting exit of air from said second pipe section to the exterior thereof.

2. The valve system of claim 1, wherein said main valve comprises a valve body; said first means comprises flexible membrane means in said valve body; said flexible membrane means being deflectable to selectively block closed said main valve and to open said main valve.

3. The valve system of claim 2, wherein said second means comprises a fluid pressure communicating duct and comprises chamber means at one side of said membrane means and communicating with said duct; said duct and said chamber means being fluid pressurizable to shift said membrane means to one of its said positions and to be unpressurizable to shift said membrane means to the other of its said positions.

4. The valve system of claim 3, wherein said membrane means is in the form of elastic tube means having an inside and an outside and said chamber means is at said outside of said tube means.

5. The valve system of claim 4, wherein said tube means is comprised of two semi-cylindrical sections, each terminating at longitudinal edges and said tube means joined together at longitudinally extending junctions at their said longitudinal edges to define said tube means; said semi-cylindrical sections being non-deflectably supported by said main valve body at said junctions between said semi-cylindrical sections;

said chamber means comprising a respective said chamber outside each said semi-cylindrical tube means section; a respective said duct communicating into each said chamber.

6. A valve system for connecting pipes in a drilling rig, wherein sludge is extracted through the pipes, comprising:

a first pipe section and a second pipe section;

a main valve connected between said first and said second pipe sections for connecting said pipe sections; said main valve being disconnectable from said second pipe section while remaining connected to said first pipe section;

first means operable by fluid pressure for selectively closing said main valve, whereby said second pipe section may be disconnected from said first pipe section without sludge leaking from said first pipe section, and for opening said main valve; second means in said main valve for communicating fluid pressure to said first means;

a secondary valve connected to said second pipe section at the side of said main valve that communicates with said second pipe section; said secondary valve communicating externally of said second pipe section for permitting exit of air from said second pipe section to the exterior thereof;

said secondary valve comprises a cylinder communicating with said second means of said main valve; a piston slidable in said cylinder and movable therein under the influence of pressure in said second means; said piston being movable to open said secondary valve for permitting exit of air in said second pipe section upon decreased pressure in said second means.

7. The valve system of claim 6, wherein said secondary valve comprises an escape duct communicating from the pressure inside said second pipe to the exterior of said second pipe;

said piston having a bypass means thereon positioned such that with said piston not moved by pressure in said second means, said escape duct is open, and with said piston shifted under the influence of pressure in said second means, said escape duct is closed.

8. The valve system of claim 7, further comprising a one-way check valve in said escape duct between the pressure in said second pipe and said cylinder.

9. A valve system for connecting pipes in a drilling rig, wherein sludge is extracted through the pipes, comprising:

a first pipe section and a second pipe section;

a main valve connected between said first and said second pipe sections for connecting said pipe sections; said main valve being disconnectable from said second pipe section while remaining connected to said first pipe section;

first means operable by fluid pressure for selectively closing said main valve, whereby said second pipe section may be disconnected from said first pipe section without sludge leaking from said first pipe section, and for opening said main valve; second means in said main valve for communicating fluid pressure to said first means;

a secondary valve connected to said second pipe section at the side of said main valve that communicates with said second pipe section; said secondary valve communicating externally of said second pipe section for permitting exit of air from said second pipe section to the exterior thereof; said secondary valve communicating with said second means of said main valve; said secondary valve being openable for permitting exit of air that is in said second pipe section through said secondary valve and said secondary valve being closeable to block exit of air through said secondary valve from said second pipe section; said secondary valve being in communication with said second means of said main valve such that upon increase of pressure in said second means, said secondary valve is closed and upon decrease of pressure in said main valve, said secondary valve is opened.

10. A rotatable drive shaft for a drill bit comprising separable pipe sections wherein sludge is conveyed through said drive shaft and a valve system for connecting said pipe sections in said drive shaft, comprising:

a first pipe section and a second pipe section of said drive shaft;

a main valve connected between said first and said second pipe sections for connecting said pipe sections; said main valve being disconnectable from said second pipe section while remaining connected to said first pipe section; said main valve comprises a valve body;

flexible membrane means in said valve body; said flexible membrane means being deflectable by fluid pressure to selectively block closed said main valve, whereby said second pipe section may be disconnected from said first pipe section without sludge leaking from said first pipe section, and to open said main valve;

second means in said main valve for communicating fluid pressure to said first means; said second means comprises a fluid pressure communicating duct and comprises chamber means at one side of said membrane means and communicating with said duct; said duct and said chamber means being fluid pressurizable to shift said membrane means to one of its said positions and to be unpressurizable to shift said membrane means to the other of its said positions;

a secondary valve connected to said second pipe section at the side of said main valve that communicates with said second pipe section; said secondary valve communicating externally of said second pipe section for permitting exit of air from said second pipe section to the exterior thereof.

* * * * *